US011352849B2

(12) United States Patent
Hepburn et al.

(10) Patent No.: US 11,352,849 B2
(45) Date of Patent: Jun. 7, 2022

(54) METHODS AND SYSTEMS FOR DRILLING A MULTILATERAL WELL

(71) Applicant: HALLIBURTON ENERGY SERVICES, INC., Houston, TX (US)

(72) Inventors: Neil Hepburn, Newcastle-Upon-Tyne (GB); Stuart A. Telfer, Stonehaven (GB)

(73) Assignee: Halliburton Energy Services, Inc., Houston, TX (US)

( * ) Notice: Subject to any disclaimer, the term of this patent is extended or adjusted under 35 U.S.C. 154(b) by 454 days.

(21) Appl. No.: 16/466,722

(22) PCT Filed: Aug. 7, 2018

(86) PCT No.: PCT/US2018/045628

§ 371 (c)(1),
(2) Date: Jun. 5, 2019

(87) PCT Pub. No.: WO2020/032934

PCT Pub. Date: Feb. 13, 2020

(65) Prior Publication Data

US 2021/0332658 A1 Oct. 28, 2021

(51) Int. Cl.
*E21B 29/06* (2006.01)
*E21B 23/12* (2006.01)
(Continued)

(52) U.S. Cl.
CPC ..... *E21B 29/06* (2013.01); *E21B 7/061* (2013.01); *E21B 41/0042* (2013.01); *E21B 43/14* (2013.01)

(58) Field of Classification Search
CPC ..... E21B 7/061; E21B 29/06; E21B 41/0035
See application file for complete search history.

(56) References Cited

U.S. PATENT DOCUMENTS 5,318,121 A * 6/1994 Brockman ..... E21B 7/061 166/313
5,411,082 A 5/1995 Kennedy
(Continued)

FOREIGN PATENT DOCUMENTS

EP 0685628 A1 12/1995
RU 2531511 C1 10/2014
(Continued)

OTHER PUBLICATIONS

International Search Report and Written Opinion dated May 3, 2019 for PCT Application No. PCT/US2018/045628 filed Aug. 7, 2018 (11 pages).

(Continued)

*Primary Examiner* — Robert E Fuller
*Assistant Examiner* — Lamia Quaim
(74) *Attorney, Agent, or Firm* — K&L Gates LLP

(57) ABSTRACT

A deflector assembly for an object in a well. The deflector assembly may include a tubular housing and a core plug. The tubular housing may include a window through a wall of the tubular housing, a deflector below the window. The deflector may include a cavity extending through an axial length of the deflector and a deflector angled surface that is shaped to direct the object toward the window. The core plug may be removably coupleable within the cavity and include a receptacle and a second angled surface that is shaped to direct the object toward the window. The second angled surface is aligned with the deflector angled surface. The core plug may be coupleable with the deflector so as to rotate with the deflector.

21 Claims, 12 Drawing Sheets

(51) Int. Cl.

| | |
|---|---|
| ***E21B 7/06*** | (2006.01) |
| ***E21B 41/00*** | (2006.01) |
| *E21B 43/14* | (2006.01) |

(56) References Cited

U.S. PATENT DOCUMENTS

| | | | | |
|---|---|---|---|---|
| 5,427,177 | A | 6/1995 | Jordan, Jr. et al. | |
| 5,715,891 | A | 2/1998 | Graham | |
| 6,012,527 | A | 1/2000 | Nitis et al. | |
| 6,209,644 | B1 * | 4/2001 | Brunet | E21B 41/0042 166/117.6 |
| 6,279,659 | B1 | 8/2001 | Brunet | |
| 6,752,211 | B2 | 6/2004 | Dewey et al. | |
| 6,923,274 | B2 | 8/2005 | Rodgers et al. | |
| 7,207,390 | B1 | 4/2007 | Pratt | |
| 2016/0145956 | A1 * | 5/2016 | Dahl | E21B 29/06 166/382 |

FOREIGN PATENT DOCUMENTS

| | | | |
|---|---|---|---|
| RU | 2649711 | C1 | 4/2018 |
| RU | 2651659 | C1 | 4/2018 |
| WO | 2012003084 | A2 | 1/2012 |

OTHER PUBLICATIONS

Oberkircher et al.,"Multilateral Systems for Deep Water Reservoirs", AADE Technical Conference, 2003, pp. 1-7.

* cited by examiner

METHODS AND SYSTEMS FOR DRILLING A MULTILATERAL WELL

BACKGROUND

This section is intended to provide relevant background information to facilitate a better understanding of the various aspects of the described embodiments. Accordingly, it should be understood that these statements are to be read in this light and not as admissions of prior art.

Hydrocarbons can be produced through relatively complex wellbores traversing a subterranean formation. Some wellbores can include multilateral wellbores that include one or more lateral wellbores extending from a main wellbore. A lateral wellbore is a wellbore that is diverted from the main wellbore from a first general direction to a second general direction.

A multilateral wellbore can include one or more windows or casing exits to allow corresponding lateral wellbores to be formed. The window or casing exit for a multilateral wellbore can be formed by positioning a deflector assembly in a casing string with a running tool at a desired location in the main wellbore. The deflector assembly may be used to deflect a window mill relative to the casing string. The deflected window mill penetrates part of the casing joint to form the window or casing exit in the casing string and is then withdrawn from the wellbore. Drill assemblies can be subsequently inserted through the casing exit in order to cut the lateral wellbore. However, this increases the number of trips required downhole into the wellbore to complete the well.

BRIEF DESCRIPTION OF THE DRAWINGS

Embodiments of the deflector assembly are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers a direction that is towards the surface of the well, while the term "downhole" refers a direction that is away from the surface of the well.

The present disclosure provides a deflector assembly that includes a pre-formed window that can be sent downhole with a casing string positioned in the main wellbore, reducing the total number of trips that must be made downhole to complete the wellbore.

Figure 1:
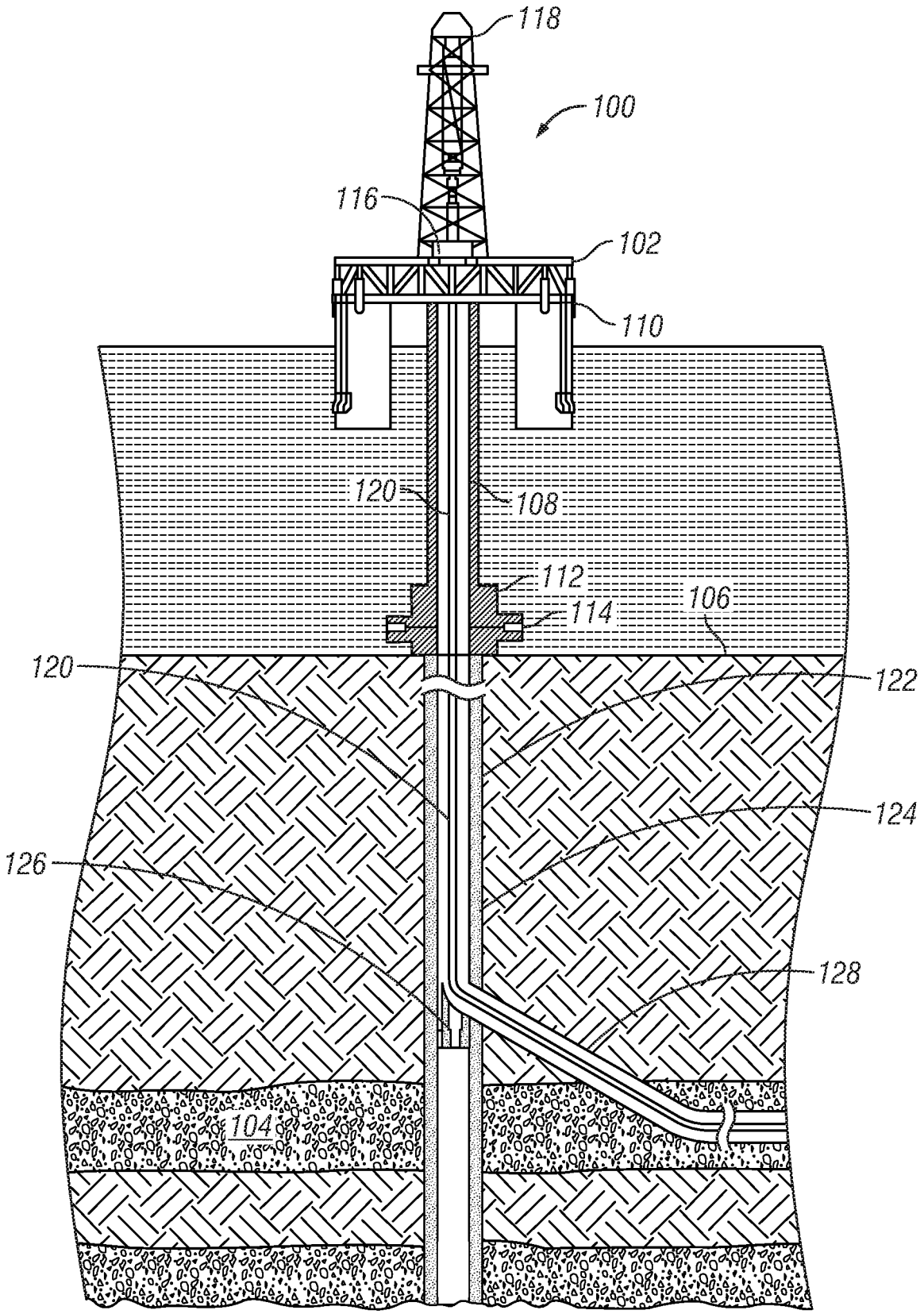
FIG. 1 is a schematic view of an offshore well system including a deflector assembly, according to one or more embodiments.

FIG. 1 is a schematic view of an offshore oil and gas system 100, according to one or more embodiments disclosed. The offshore oil and gas system 100 includes a platform 102, which may be a semi-submersible platform, positioned over a submerged oil and gas formation 104 located below the sea floor 106. A subsea conduit 108 extends from the deck 110 of the platform 102 to a wellhead installation 112 including one or more blowout preventers 114. The platform 102 has a hoisting apparatus 116 and a derrick 118 for raising and lowering pipe strings, such as a drill string 120. Although an offshore oil and gas platform 102 is illustrated in FIG. 1, the scope of this disclosure is not thereby limited. The teachings of this disclosure may also be applied to other offshore oil and gas systems or land-based oil and gas systems.

As shown, a main wellbore 122 has been drilled through the various earth strata, including the formation 104. The term "main" wellbore is used herein to designate a wellbore from which another wellbore is drilled. It is to be noted, however, that a main wellbore does not necessarily extend directly to the earth's surface, but could instead be a branch of yet another wellbore. A casing string 124 may be at least partially cemented within the main wellbore 122. The term "casing" is used herein to designate a tubular string used to line a wellbore. Casing may actually be of the type known to those skilled in the art as "liner" and may be made of any material, such as steel or composite material and may be segmented or continuous, such as coiled tubing.

A deflector assembly 126 may be installed in or otherwise form part of the casing string 124. As illustrated, the deflector assembly 126 is positioned at a desired intersection between the main wellbore 122 and a lateral wellbore 128. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

Figure 2:
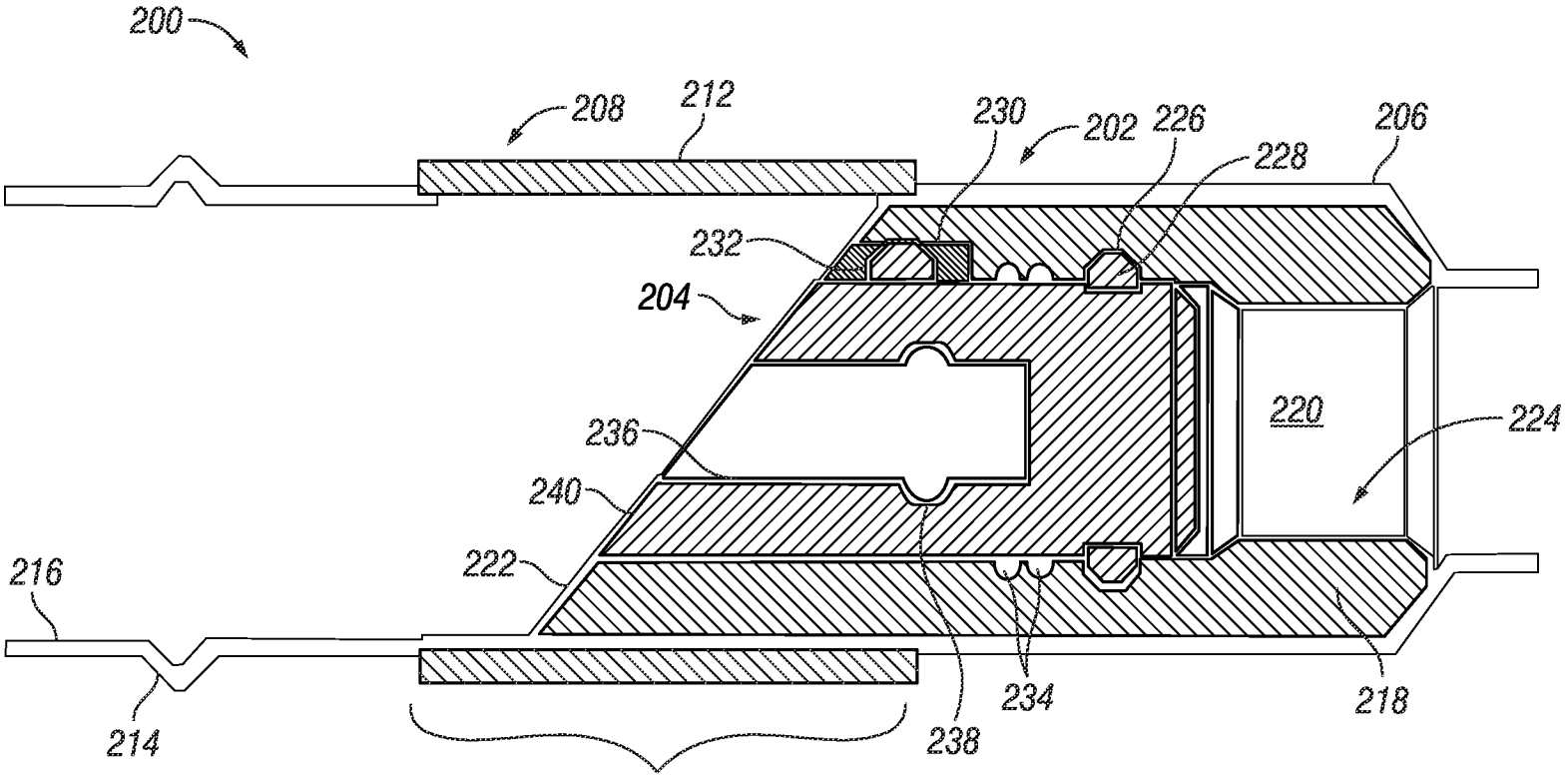
FIG. 2 is a cross-sectional view of a deflector assembly, according to one or more embodiments.

FIG. 2 is a cross-sectional view of a deflector assembly 200, according to one or more embodiments. The deflector assembly 200 may be used in place of the deflector assembly 126 shown in FIG. 1. As shown in FIG. 2, the deflector assembly 200 includes a tubular housing 202 and a core plug 204.

A wall 206 of the tubular housing 202 includes a window 208 through the wall 206 to allow a drilling assembly (not show) to pass through the wall 206 with reduced resistance. A portion of the wall 206 may remain intact along a portion 210 of tubular housing 202 that includes the window 208. In some embodiments, a wrap 212 surrounds the tubular housing 202 along the portion 210 that includes the window 208 to prevent debris from entering the deflector assembly 200 through the window 208. The wrap 212 may be made of aluminum, a composite material, or a similar non-metallic material that allows the window 208 to be opened with a conventional drill bit, removing the need for a specialized milling operation to be conducted prior to drilling a lateral wellbore through the window 208. In other embodiments, the wrap 212 may be omitted.

The tubular housing 202 may also include a latch profile 214 in an interior surface 216 of the wall 206. As described in more detail below, the latch profile 214 receives a latch coupling of a drilling tool (not shown) to temporarily couple the drilling tool to the deflection assembly 200. The latch profile also 214 prevents relative rotation between the deflector assembly 200 and the drilling tool. In other embodiments, the interior surface 216 of the wall 206 further includes a keyway (not shown) that receives a key of the drilling tool to prevent relative rotation between the deflector assembly 200 and the drilling tool.

A deflector 218 is coupled to or formed integrally as part of the tubular housing 202, as shown in FIG. 2. The deflector 218 includes a cavity 220 that extends through the axial length of the deflector 218 and an angled surface 222 that is shaped to direct objects toward the window 208. As shown, the interior diameter of the cavity 220 may vary along the axial length of the deflector 218.

An interior surface 224 of the deflector 218 includes a latch profile 226 that receives a latch coupling 228 of the core plug 204. The latch coupling 228 removably couples the core plug 204 to the deflector 218. The interior surface 224 of the deflector may also include a keyway 230 that receives a key 232 of the core plug 204. The keyway 230 and key 232 prevent relative rotation between the deflector 218 and the core plug 204 while allowing relative axial movement. In another embodiment, the keyway 230 and key 232 may be omitted, and the latch profile 226 and latch coupling 228 may prevent relative rotation between the deflector 218 and the core plug 204. One or more seals (two shown, 234) between the core plug 204 and the deflector 218 prevent fluid communication through the deflector assembly 200 when the core plug 204 is installed.

The core 204 plug also includes a receptacle 236 extending through a portion of the axial length of the core plug 204. The receptacle 236 includes a latch profile 238 that receives a latch coupling of a drilling tool (not shown) to temporarily couple the drilling tool to the core plug 200 for installation and positioning of the deflector assembly 200 or retrieval of the core plug 204. In some embodiments, the latch profile also 238 prevents relative rotation between the core plug 204 and the drilling tool. In other embodiments, the receptacle 236 of the core plug 204 further includes a keyway (not shown) that receives a key of the drilling tool to prevent relative rotation between the core plug 204 and the drilling tool.

The core plug 204 further includes a core plug angled surface 240. The core plug angled surface 240 is aligned with the deflector angled surface 222, as shown in FIG. 2. As with the deflector angled surface 222, the core plug angled surface 240 is shaped to direct objects toward the window 208.

Figure 3:
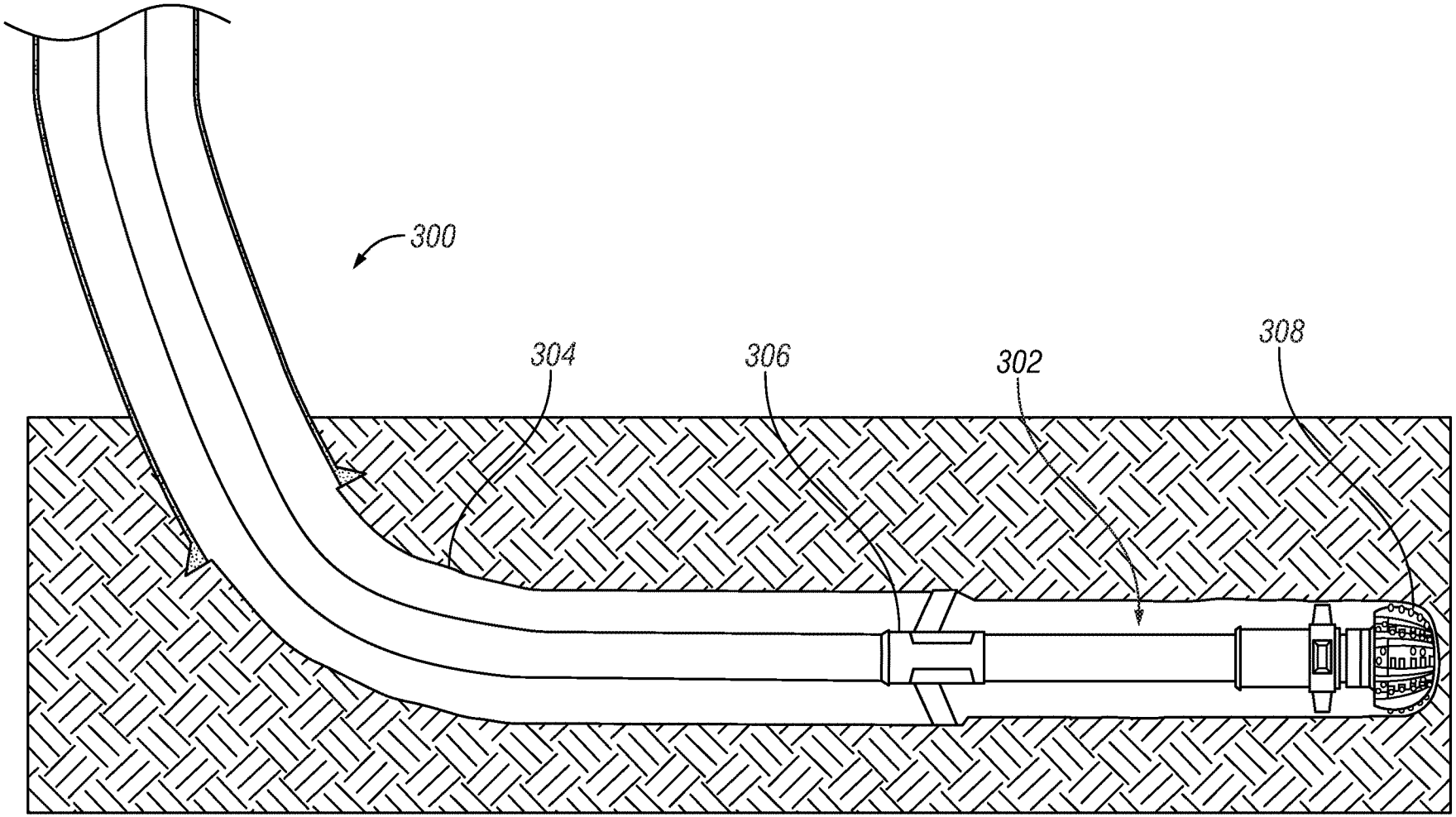
FIG. 3 is a partial, cross-sectional view of a well system being drilled.

FIGS. 3-12 show the installation and used of the deflector assembly 200 in a well system 300. As previously discussed, the well system 300 may be drilled on-shore or off-shore. As shown in FIG. 3, a drilling assembly 302 is used to drill a main wellbore 304. The drilling assembly 302 also includes a reamer 306 positioned uphole of the drill bit 308. The reamer 306 increases the diameter of the wellbore 304 that is drilled by the drill bit 308. In some well systems 300, the use of a reamer 306 may not be necessary and the reamer 306 may be omitted from the drilling assembly 302.

Figure 4:
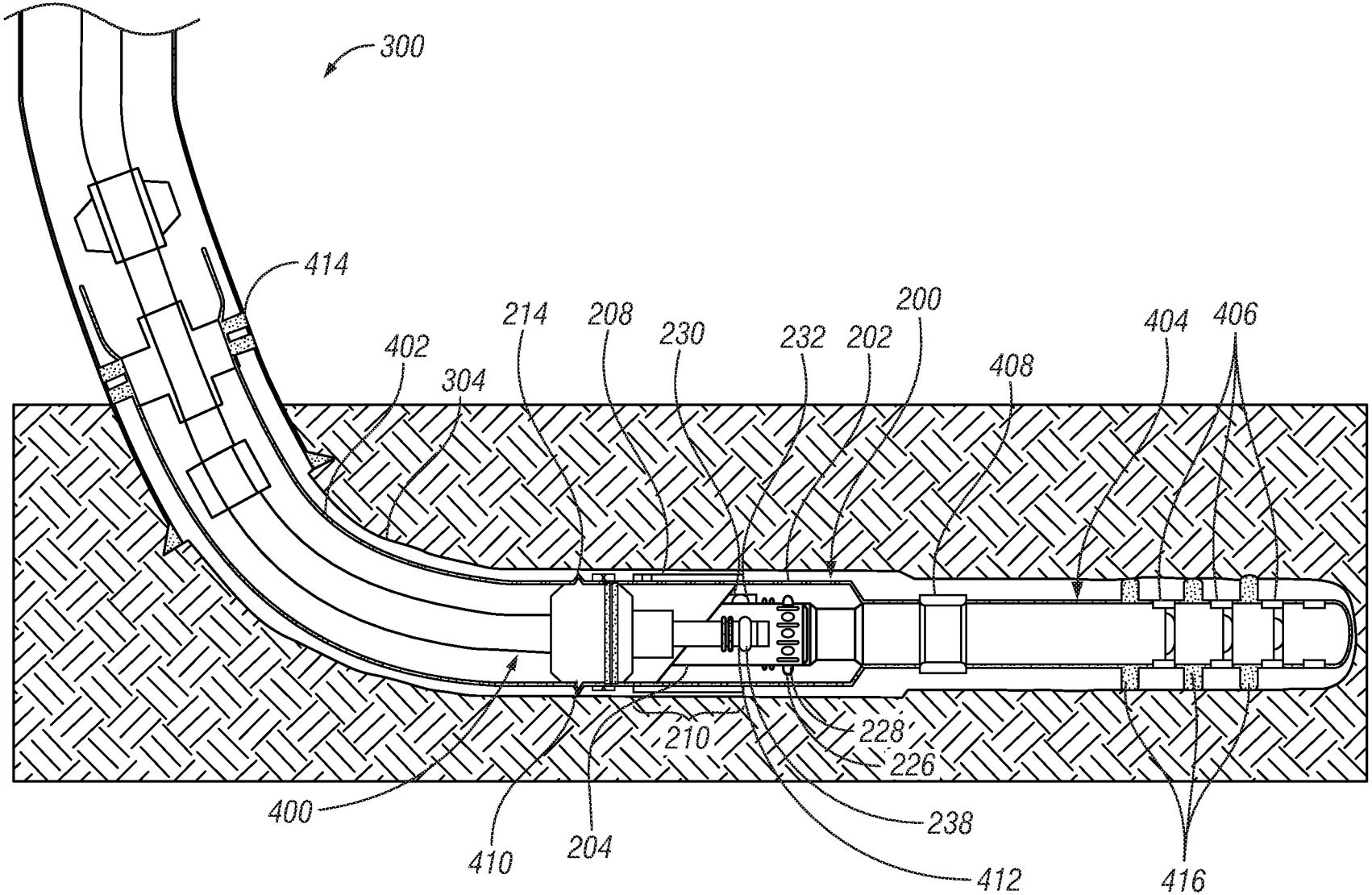
FIG. 4 is a partial, cross-sectional view of the well system of FIG. 3 including a deflector assembly and a running tool positioned within a main wellbore.

After the main wellbore 304 is drilled, a running tool 400 and a liner 402 or casing string that includes the deflector assembly 200 and a mainbore completion 404 including one or more stimulation sleeves 406 are run into the main wellbore 304. The running tool positions the liner 402, the deflector assembly 200, and the mainbore completion 404 in the main wellbore 304, as shown in FIG. 4. The stimulation sleeves 406 are sized to receive drop balls (not shown) to isolate portions of the mainbore completion 404 during stimulation operations. The deflector assembly 200 may be coupled to the liner 402 via a threaded connection (not shown), a coupling (not shown), a swivel (not shown), or other similar means known in the art. Similarly, the mainbore completion 404 may be coupled to the deflector assembly 200 via a swivel 408, a coupling, a threaded connection, or similar means. The running tool 400 may rotate the liner 402, the deflector assembly 200, and the mainbore completion 404 into the desired orientation after the running tool reaches the desired position within the main wellbore 304.

As previously discussed, latch couplings 410, 412 on the running tool 400 and latch profiles 214, 238 on the deflector assembly 200 removably couple the running tool 400 to the deflector assembly 200 and prevent relative rotation between the running tool 400, the tubular housing 202, and the core plug 204. In other embodiments, one or more keys and keyways may be used to prevent relative rotation between the running tool 400, tubular housing 202, and the core plug 204. The core plug key 232 and the tubular housing keyway 230 prevent relative rotation between the core plug 204 and the tubular housing 202. Alternatively, the latch profile 226 of the tubular housing 202 and latch coupling 228 of the core plug 204 may prevent relative rotation between the core plug 204 and the tubular housing 202. The key 232, keyway 230, latch profiles 214, 238, and respective latch couplings 410, 412 prohibit relative rotation, allowing the running tool 400 to rotate the liner 402, the deflector assembly 200, and the mainbore completion 404 without transferring torque through the portion 210 of the tubular housing 202 that includes the window 208. Preventing the transfer of torque through the portion 210 of the tubular housing 202 that includes the window 208 maintains the integrity of the deflector assembly 200 during rotation of the liner 402.

Once the liner 402, the deflector assembly 200, and the mainbore completion 404 are positioned and oriented within the main wellbore 304 by the running tool 400, a liner hanger 414 or packer is set within the main wellbore 304 prior to the running tool 400 being withdrawn from the main wellbore 304. The liner hanger 414 maintains the position and orientation the liner 402, the deflector assembly 200, and the mainbore completion 404. Additionally, one or more packers or swelling elements (416, three shown) are used to maintain the position of the mainbore completion 404. The running, positioning, and setting of the liner 402, the deflector assembly 200, and the mainbore completion 404, as described above, occurs in a single trip downhole. However, these operations may also occur in multiple trips downhole.

Once the liner 402 and deflector assembly 202 are positioned within the main wellbore 304 and the liner hanger 414 is set, the running tool 400 decouples from the core plug 204 and is withdrawn from the main wellbore 304. A drilling assembly 500 is then run downhole. The force required to decouple the running tool 400 from the core plug 204 is less than the force required to decouple the core plug 204 from the tubular housing 202. This allows the core plug 204 to remain positioned within the tubular housing 202 after the running tool 400 is withdrawn from the main wellbore 304.

Figure 5:
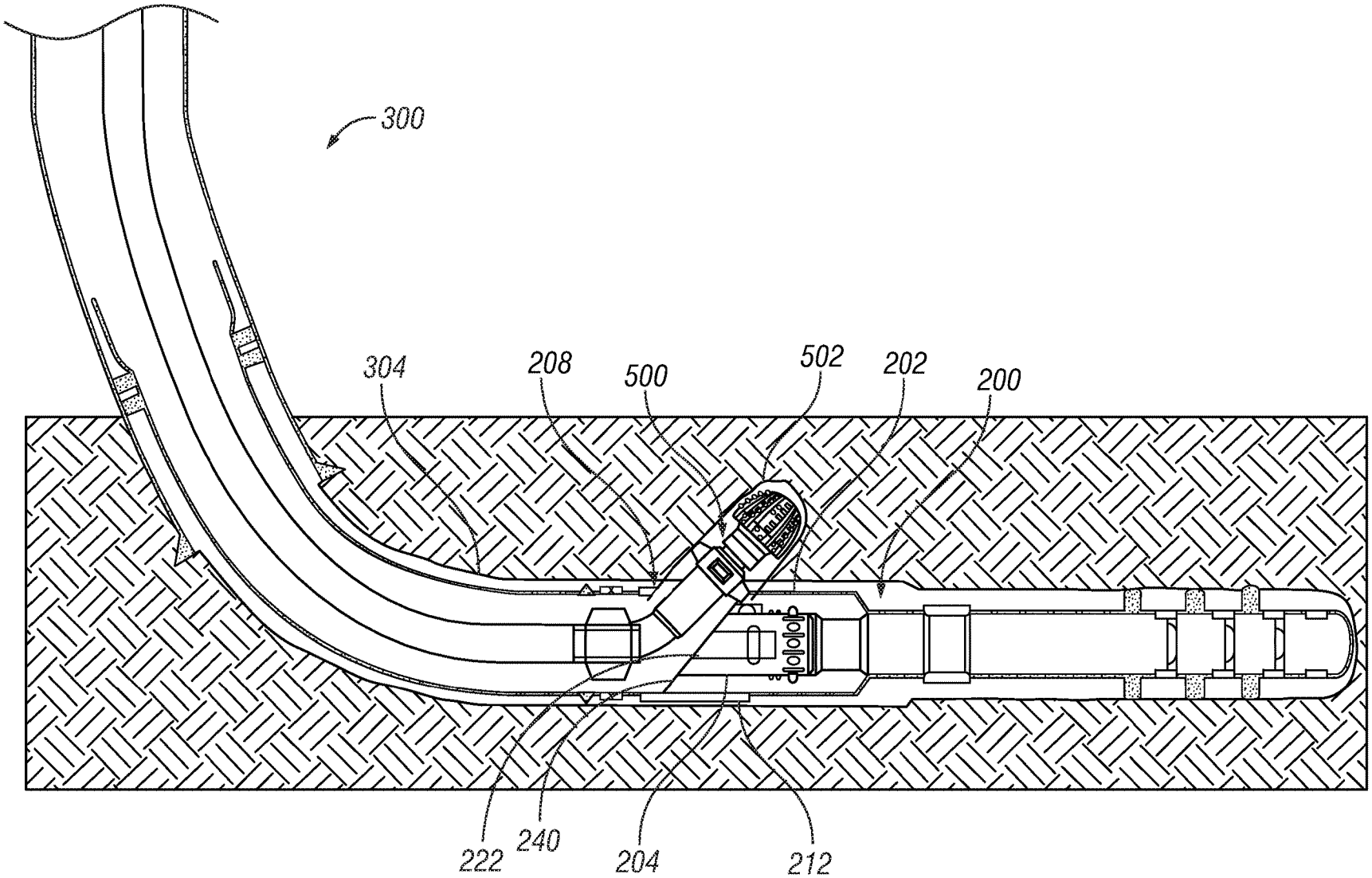
FIG. 5 is a partial, cross-sectional view of the well system of FIG. 4 including a drilling assembly being deflected to drill a lateral wellbore.
Figure 6:
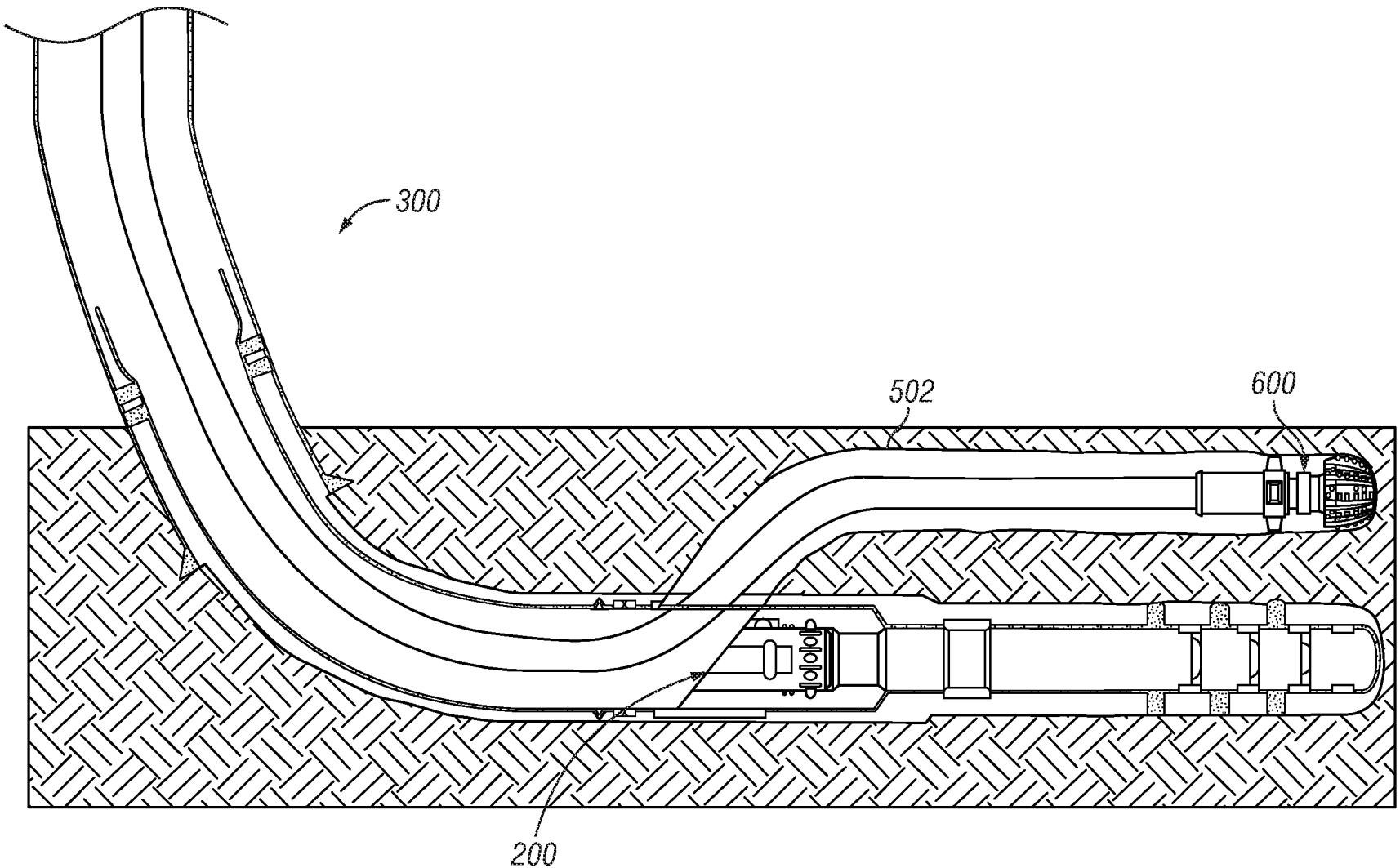
FIG. 6 is a partial, cross-sectional view of the well system of FIG. 5 including a lateral wellbore being drilled.

As shown in FIG. 5, the drilling assembly 500 is deflected off of the angled surfaces 222, 240 of the tubular housing 202 and the core plug 204. The drilling assembly 500 passes through the wrap 212 and the window 208 in the tubular housing 202 and proceeds to drill a lateral wellbore 502. In some embodiments, the drilling assembly 500 may be used to drill the entire lateral wellbore 502. In other embodiments, the drilling assembly 500 is withdrawn from the lateral wellbore 502 and the main wellbore 304 after drilling an initial portion of the lateral wellbore 502, and a second drilling assembly 600 is run downhole to complete the drilling of the lateral wellbore 502, as shown in FIG. 6. As with drilling assembly 500, drilling assembly 600 is deflected off of the deflector assembly 200.

Figure 7:
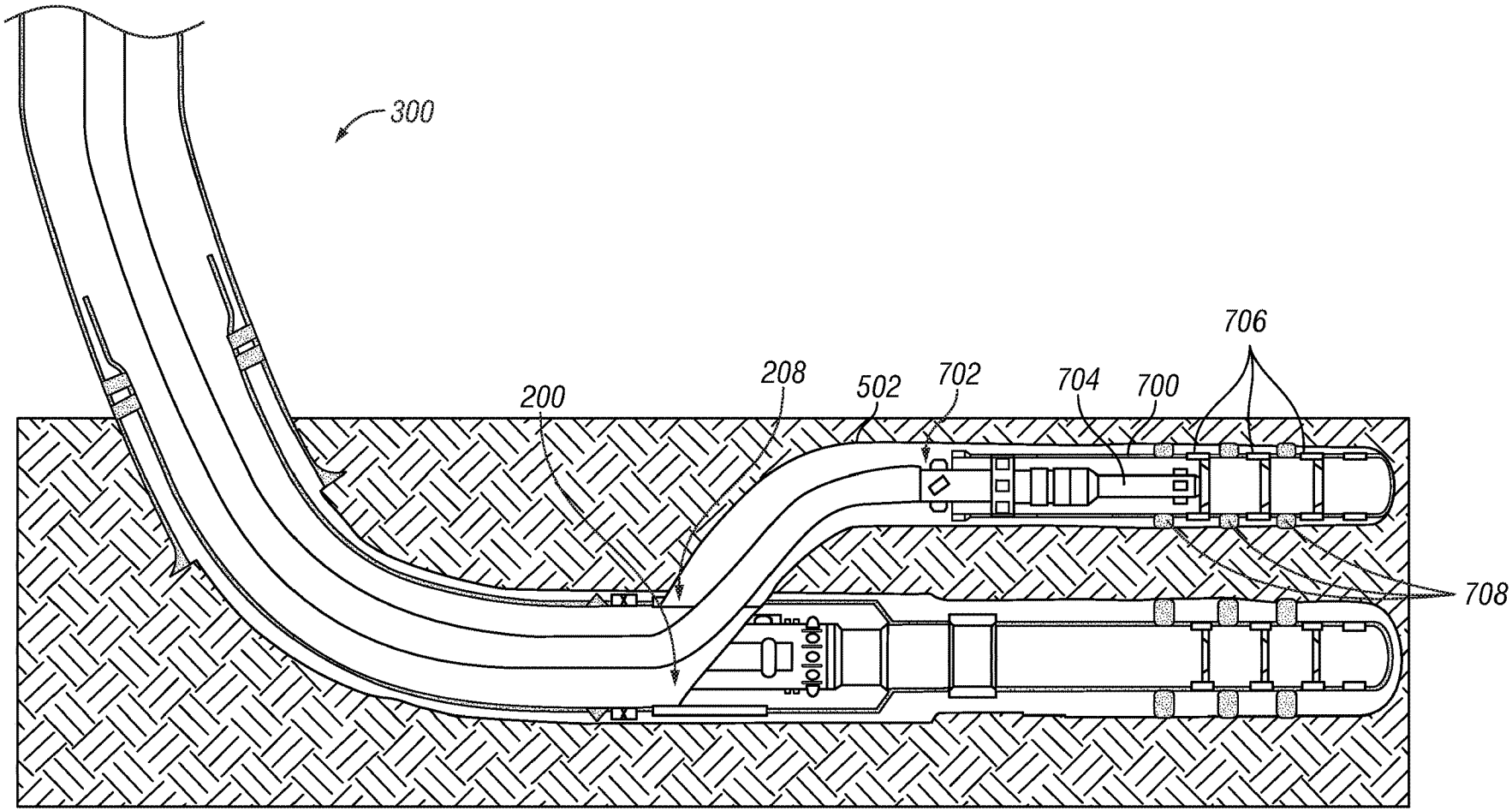
FIG. 7 is a partial, cross-sectional view of the well system of FIG. 6 including a lateral completion being installed in the lateral wellbore.

After the lateral wellbore 502 is drilled, the drilling assembly 500, 600 is withdrawn from the lateral wellbore 502 and the main wellbore 304, and a lateral completion 700 is run downhole with a running tool 702 that includes a retrieving tool 704. Similar to the mainbore completion 404, the lateral completion includes one or more stimulation sleeves (three shown, 706) to receive drop balls (not shown) to isolate portions of the lateral completion 700 during stimulation operations, and one or more packers or swelling elements (three shown, 708) that maintain the position of the lateral completion. The lateral completion 700 is deflected off the deflector assembly 200 and passes through the window 208 into the lateral wellbore 502. Once the lateral completion 700 reaches the desired position within the lateral wellbore 502, as shown in FIG. 7, it is released from the running tool 702. The lateral completion 700 may be released by pumping fluid downhole to increase an internal pressure of the running tool 702 and actuate a valve assembly (not shown). In another embodiment, an electronic signal may trigger the actuation of the valve assembly.

Figure 8:
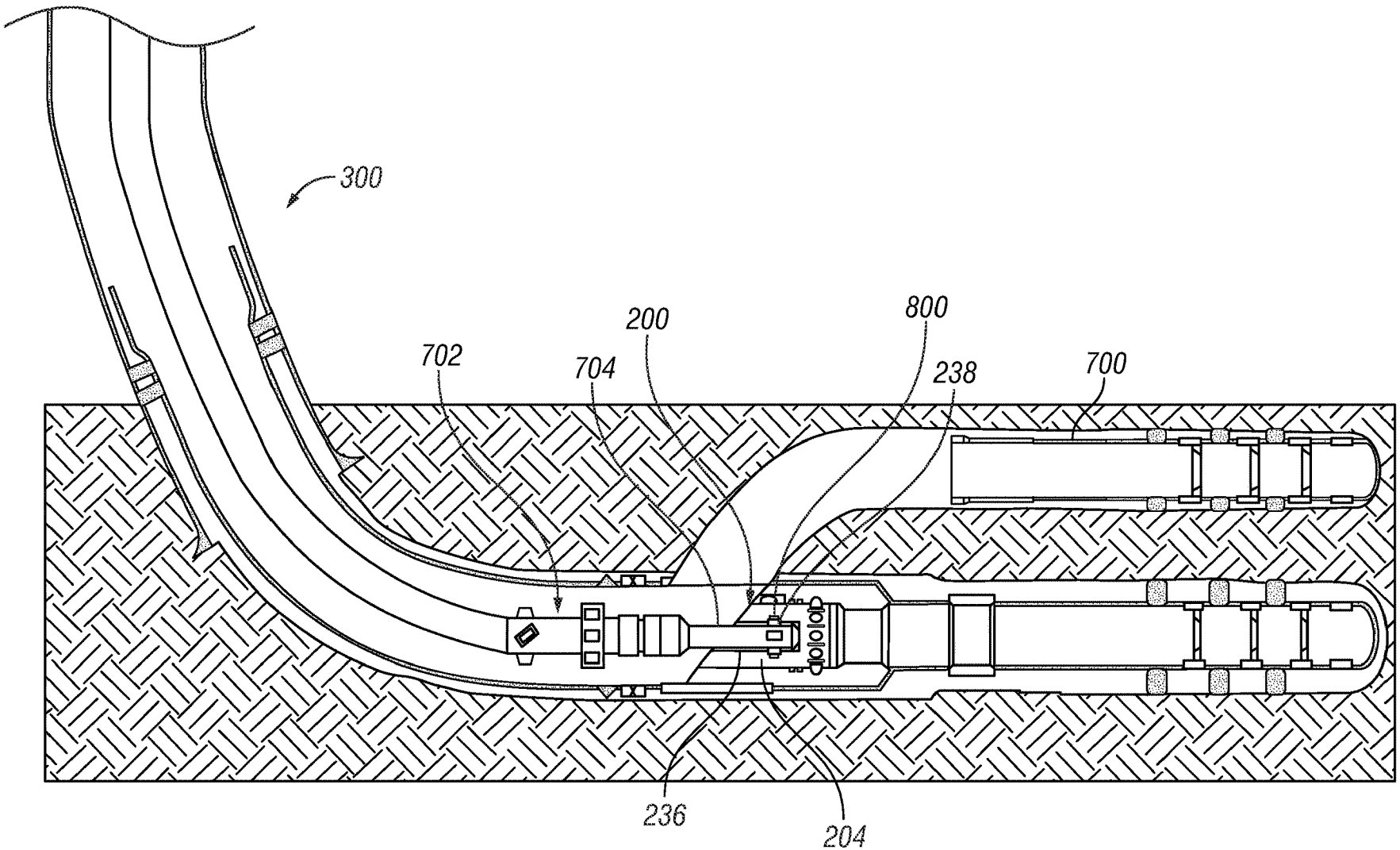
FIG. 8 is a partial, cross-sectional view of the well system of FIG. 7 including a core plug removal tool removing the core plug.

As shown in FIG. 8, the running tool 702 is withdrawn from the lateral wellbore 502 after releasing the lateral completion 700. A latch coupling 800 of the retrieving tool 704 is then engaged with the latch profile 238 the receptacle 236 to removably couple the core plug 204 with the retrieving tool 704. The force required to decouple the retrieving tool 704 and the core plug 204 is greater than the force required to decouple the core plug 204 and the tubular housing 202, allowing the retrieving tool 704 to remove the core plug 204. The running tool 702 is then withdrawn from the main wellbore 304 to remove the core plug 204 from the deflection assembly 200. Although the retrieving tool 704 is described as part of the running tool 702, the running tool 702 may be withdrawn from the wellbore without engaging with the core plug 204 or the running tool 702 may not include a retrieving tool 704. A separate retrieving tool (not shown) may then be run downhole to engage with and remove the core plug 204.

Figure 9:
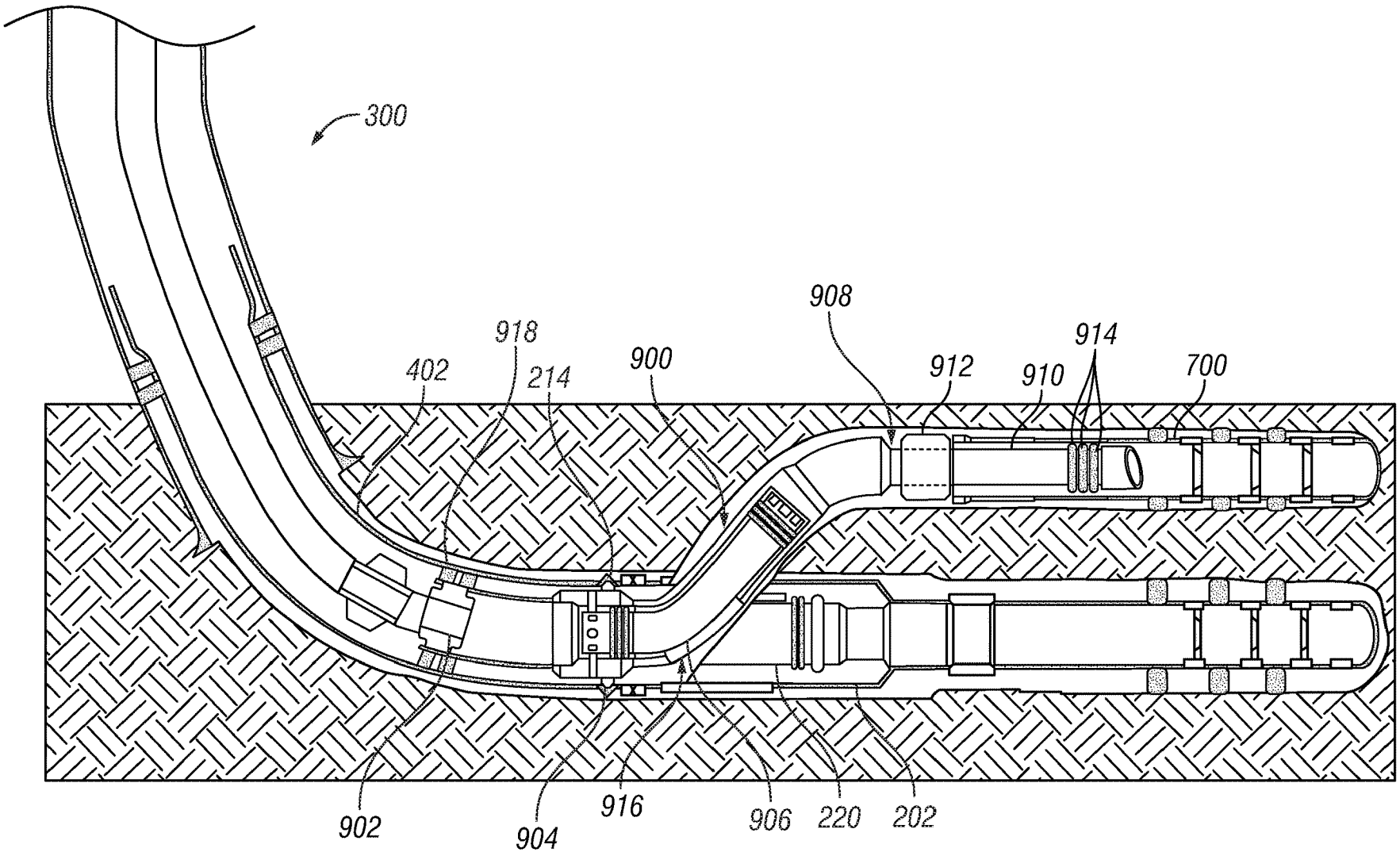
FIG. 9 is a partial, cross-sectional view of the well system of FIG. 8 including a window transition joint and a shrouded stinger.

Once the core plug 204 is removed from the deflector assembly 200, a window transition joint 900 is run downhole with a running tool 902 to connect the liner 402 with the lateral completion 700. As shown in FIG. 9, the window transition joint 900 includes a latch coupling 904, a removable lateral isolation sleeve 906 and a shrouded stinger 908. The shrouded stinger 908 includes a seal stinger 910 that is initially covered by a shroud 912 to prevent damage to one or more seals (three shown, 914) of the seal stinger 910 as the window transition joint 900 is run downhole. Once the shrouded stinger 908 contacts the lateral completion 700, a force is applied to the shrouded stinger 908, causing the shroud 912 to shear and allowing the seal stinger 910 to seal against the lateral completion 700.

As the seal stinger is positioned within the lateral completion 700, the window transition joint 900 is rotated to allow a window 916 to align with the cavity 220 of the tubular housing 202. The latch coupling 904 then engages with the latch profile 214 of the tubular housing 202 to retain the window transition joint 900 in position within the main wellbore 302 and lateral wellbore 502. Once the latch coupling 904 engages with the latch profile 214, a hanger 918 or packer is set to further maintain the orientation and position of the window transition joint 900 within the liner 402.

In another embodiment, the lateral completion 700 may be coupled to the window transition joint 900 to form a single assembly, removing the need for a shrouded stinger 908 to create a seal between the lateral completion 700 and the window transition joint. 900. If a combination lateral completion and window transition joint assembly (not shown) is used, the core plug 204 is removed prior to running the combination lateral completion and window transition joint assembly downhole. The combination lateral completion and window transition joint assembly is set within the liner 402 as described above.

Figure 10:
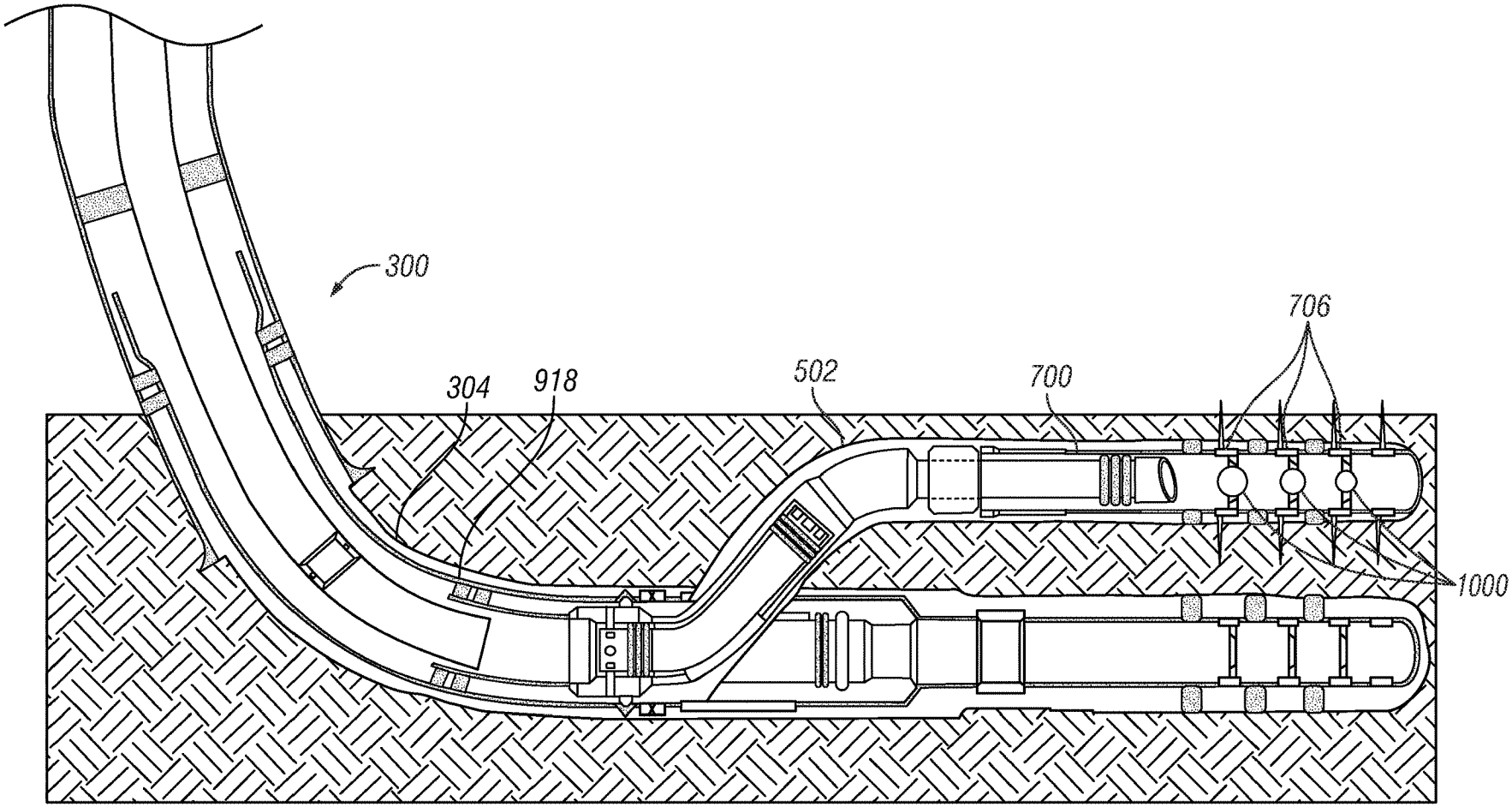
FIG. 10 is a partial, cross-sectional view of the well system of FIG. 9 illustrating stimulation of the lateral wellbore.

After the hanger 918 is set, the running tool 902 is withdrawn from the wellbore, as shown in FIG. 10, drop balls 1000 are sent down the main wellbore 304 and the lateral wellbore 502, and into the lateral completion 700 as part of stimulation operations for the formation through the lateral wellbore 502. The drop balls 1000 seat within the stimulation sleeves 706 to isolate portions of the lateral completion 700 during stimulation of the formation through the lateral wellbore 502.

Figure 11:
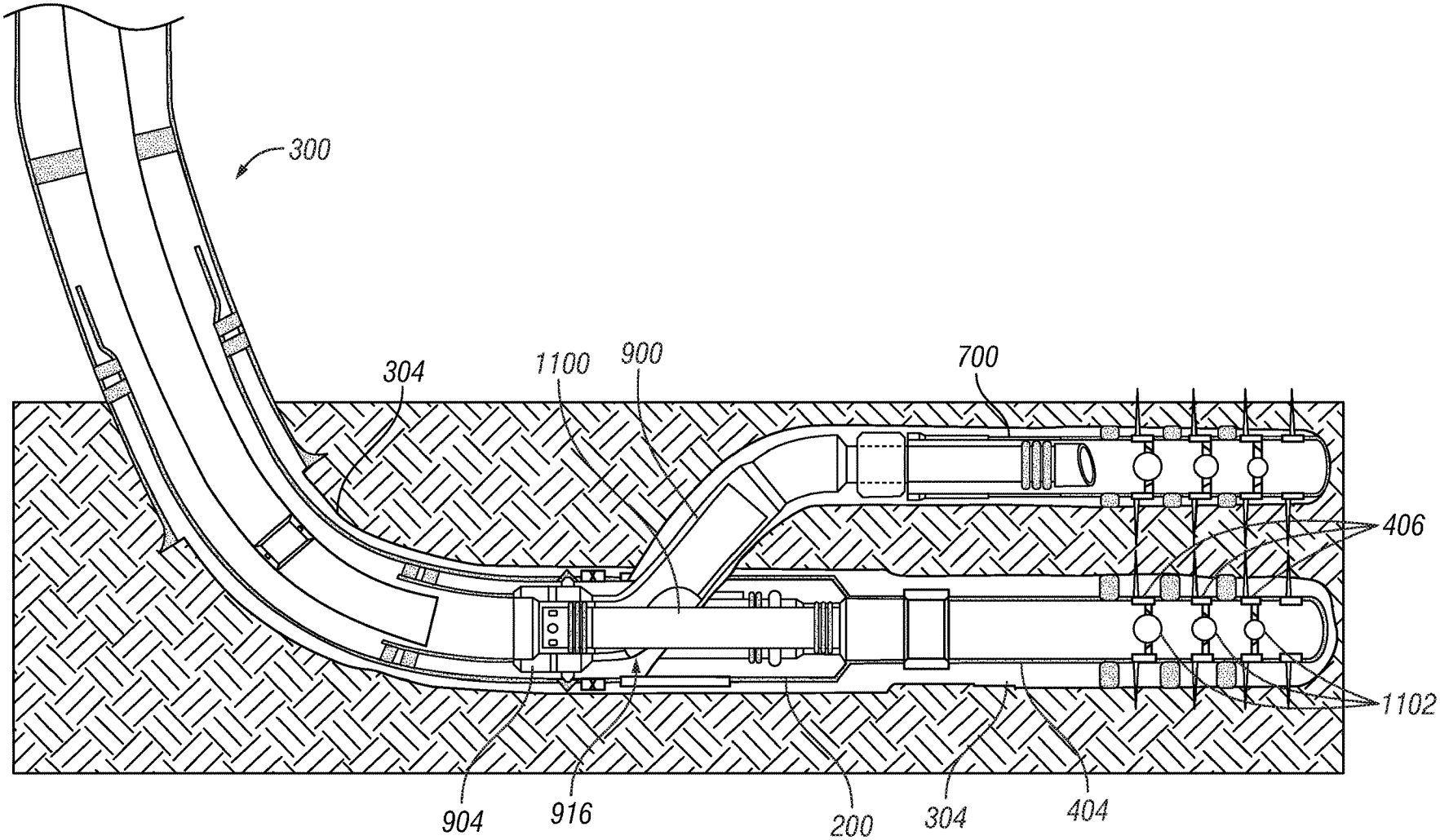
FIG. 11 is a partial, cross-sectional view of the well system FIG. 10 including a mainbore isolation sleeve.
Figure 12:
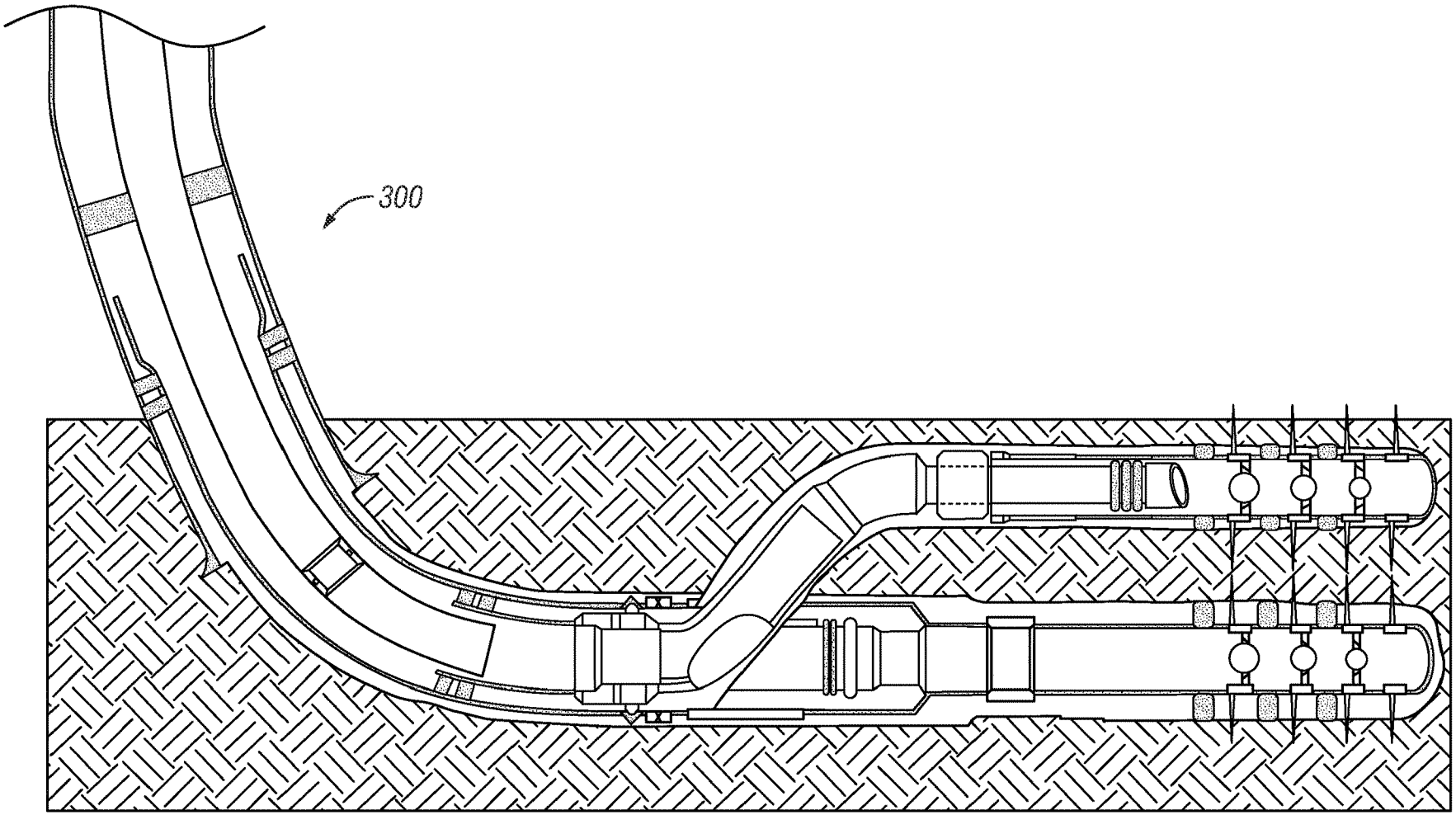
FIG. 12 is a partial, cross-sectional view of the well system of FIG. 11 with the mainbore isolation sleeve removed.

After the stimulation operations have been completed in the lateral wellbore 502, the lateral isolation sleeve 906 is withdrawn from the window transition joint 900 and a mainbore isolation sleeve 1100 is run downhole. The mainbore isolation sleeve 1100 extends through the window 916 of the window transition joint 900 and seals against the window transition joint 900 and the deflector assembly 200, as shown in FIG. 11. The mainbore isolation sleeve 1100 allows drop balls 1102 to be sent into the mainbore completion 404 as part of main wellbore stimulation operations. Similar to the lateral completion 700, the drop balls 1102 seat within the stimulation sleeves 406 to isolate portions of the mainbore completion 404 during stimulation of the main wellbore 304. After the stimulation operations have been completed in the main wellbore 304, the mainbore isolation sleeve 1100 is withdrawn from the window transition joint 900, as shown in FIG. 12, to allow production of oil, gas, or other fluids.

Although FIGS. 3-12 describe the use of a deflector assembly 200 with relatively complex types of reservoir completions, the deflector assembly 200 is not thereby limited. The deflector assembly 200 may be used with various other types of reservoir completions, such as cemented and perforated production liners, slotted liner completions with or without swell packers and/or stage cementing, sand control screens with or without swell packers, open hole gravel pack or frac-pack type completions, and other types of completions known in the art.

One or more specific embodiments of the deflector assembly have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain embodiments of the disclosed invention may include a deflector assembly for an object in a well. The deflector assembly may include a tubular housing and a core plug. The tubular housing may include a window through a wall of the tubular housing and a deflector below the window. The deflector may include a cavity extending through an axial length of the deflector and a deflector angled surface that is shaped to direct the object toward the window. The core plug may be removably coupleable within the cavity and include a receptacle and a second angled surface that is shaped to direct the object toward the window. The second angled surface is aligned with the deflector angled surface. The core plug may be coupleable with the deflector so as to rotate with the deflector.

In certain embodiments, the core plug may be removably coupleable with an inner surface of the deflector.

In certain embodiments, the core plug may further include an alignment key engageable within a keyway in the deflector. The keyway may be shaped to receive the alignment key.

In certain embodiments, the deflector assembly may further include a running tool that is removably engageable with an interior of the wall of the tubular housing and the core plug receptacle so as to be able to rotate the housing and the core plug without transmitting torque through the portion of the housing comprising the window.

In certain embodiments, the deflector assembly may further include a retrieving tool that is engageable with the core plug receptacle with the running tool removed. The retrieving tool may be retrievable to detach the core plug from the deflector and retrieve the core plug from the well.

Certain embodiments of the disclosed invention may include a well system for a multilateral well. The well system may include a main wellbore, a deflector assembly, and a running tool. The deflector assembly may include a tubular housing positioned within the main wellbore and a core plug. The tubular housing may include a window through a wall of the tubular housing and a deflector below the window. The deflector may include a cavity extending through an axial length of the deflector and a deflector angled surface that is shaped to direct the object toward the window. The core plug may be removably coupleable within the cavity and include a receptacle and a second angled surface that is shaped to direct the object toward the window. The second angled surface is aligned with the deflector angled surface. The core plug may be coupleable with the deflector so as to rotate with the deflector. The running tool may be removably engageable with an interior of the wall of the tubular housing and the core plug receptacle so as to be able to rotate the tubular housing and the core plug without transmitting torque through a portion of a wall of the tubular housing comprising the window.

In certain embodiments, the core plug may be removably coupleable with an inner surface of the deflector.

In certain embodiments, the core plug may further include an alignment key engageable within a keyway in the deflector. The keyway may be shaped to receive the alignment key.

In certain embodiments, the well system may include a hanger set within the main wellbore to secure a position and an orientation of the tubular housing.

In certain embodiments, the well system may include a retrieving tool that is engageable with a lateral completion and positionable through the window to place the lateral completion into a lateral wellbore. The retrieving tool may be detachable from the lateral completion and engageable with the core plug receptacle with the running tool removed and retrievable to detach the core plug from the deflector and retrieve the core plug from the well.

In certain embodiments, the well system may include a window transition joint that is positionable through the window of the tubular housing from the main wellbore into the lateral wellbore by engagement with the first angled surface. The window transition joint may include a tubular housing including a window through a wall of the tubular housing of the window transition joint and a lateral isolation sleeve that is removably positioned inside the window transition joint to isolate the main wellbore from the lateral wellbore.

In certain embodiments, the well system may include a lateral completion and window transition joint assembly positionable through the window of the tubular housing from the main wellbore into a lateral wellbore by engagement with the first angled surface.

Certain embodiments of the disclosed invention may include a method for drilling a multilateral well. The method may include running a deflector assembly into a main wellbore with a running tool in a first trip, the deflector assembly comprising a tubular housing and a core plug. The method may also include orienting the deflector assembly within the main wellbore with the running tool in the first trip. The method may further include setting a first hanger in the main wellbore to secure a positon and an orientation of the deflector within the main wellbore in the first trip. The method may also include drilling a lateral wellbore by deflecting a drill bit off of a deflector of the tubular housing and the core plug, and through a window through a wall of the tubular housing. The method may further include removing the core plug with a retrieving tool.

In certain embodiments, orienting the deflector assembly within the main wellbore with the running tool may include removably coupling the running tool to the core plug and to the tubular housing uphole of the window, rotating the funning tool to orient the deflector assembly within the main wellbore, where torque is not transmitted through a portion of the wall of the tubular housing comprising the window, and removing the running tool from the tubular housing and the core plug.

In certain embodiments, removably coupling the running tool to the core plug and to the tubular housing uphole of the window may include engaging the running tool with an inner surface of a receptacle of the core plug and engaging the running tool with an interior of the wall of the tubular housing uphole of the window. Removing the running tool from the tubular housing and the core plug may include disengaging the running tool from the inner surface of the receptacle and disengaging the running tool from the inner surface of the wall.

In certain embodiments, removing the core plug with the retrieving tool may include running a lateral completion into the lateral wellbore with a lateral completion running tool by deflecting the lateral completion off of the deflector assembly, releasing the lateral completion from the lateral completion running tool, and removing the core plug with the retrieving tool of the lateral completion running tool.

In certain embodiments, the method may further include installing a window transition joint through the window of the tubular housing to connect the tubular housing with the lateral completion and stimulating the formation through the lateral wellbore.

In certain embodiments, installing the window transition joint through the window of the tubular housing to connect the tubular housing with the lateral completion further includes running a first work string comprising a shrouded stinger assembly and the window transition joint into the lateral wellbore, applying a force to shear a shroud of the shrouded stinger and push a seal stinger of the shrouded stinger into the lateral completion, and setting a second hanger in the tubular housing to secure a position and an orientation of the window transition joint.

In certain embodiments, the method may further include removing a lateral isolation sleeve of the window transition joint from the lateral wellbore, running a second work string comprising a mainbore isolation sleeve into the main wellbore to isolate the lateral wellbore from the main wellbore, and stimulating the main wellbore.

In certain embodiments, the method may further include running a lateral completion and window transition joint assembly into the lateral wellbore with a lateral completion running tool by deflecting the lateral completion and window transition joint assembly off of the deflector assembly.

What is claimed is:

1. A deflector assembly for an object in a wellbore, comprising:

a tubular housing comprising:

a window through a wall of the tubular housing, and a deflector below the window and rotatable with the tubular housing, the deflector comprising a cavity extending through an axial length of the deflector and a deflector angled surface shaped to direct the object toward the window; and a core plug removably coupleable within the cavity and comprising a receptacle and a core plug angled surface shaped to direct the object toward the window and aligned with the deflector angled surface, the core plug coupleable with the deflector so as to be able to rotate the deflector and thus the tubular housing;

wherein the tubular housing and core plug are runnable together and an interior surface of the wall of the tubular housing is engageable above the window and the receptacle of the core plug is engageable below the window, such that the tubular housing and core plug are positionable and settable together to align the window to any rotation position downhole in an open-hole portion of the wellbore in a trip.

2. The deflector assembly of claim 1, wherein the core plug is removably coupleable with an inner surface of the deflector.

3. The deflector assembly of claim 1, wherein the core plug further comprises an alignment key engageable within a keyway in the deflector.

4. The deflector assembly of claim 1, further comprising a running tool removably engageable with the interior of the wall of the tubular housing and the core plug receptacle so as to be able to rotate the housing and the core plug without transmitting torque through the portion of the housing comprising the window.

5. The well system of claim 4, further comprising a retrieving tool engageable with the core plug receptacle with the running tool removed, the retrieving tool retrievable to detach the core plug from the deflector and retrieve the core plug from the wellbore.

6. A well system for a multilateral well, the well system comprising:

a main wellbore;

a deflector assembly comprising:

a tubular housing positioned within the main wellbore, the tubular housing comprising:

a window through a wall of the tubular housing, and a deflector below the window and rotatable with the tubular housing, the deflector comprising a cavity extending through an axial length of the deflector and a deflector angled surface shaped to direct the object toward the window;

a core plug removably coupleable within the cavity and comprising a receptacle and a core plug angled surface shaped to direct the object toward the window and aligned with the deflector angled surface, the core plug coupleable with the deflector so as to be able to rotate with the deflector and this the tubular housing; and a running tool removably engageable with an interior of the wall of the tubular housing above the window and the core plug receptacle below the window so as to be able to rotate the tubular housing and the core plug without transmitting torque through a portion of a wall of the tubular housing comprising the window.

7. The well system of claim 6, wherein the core plug is removably coupleable with an inner surface of the deflector.

8. The well system of claim 6, wherein the core plug further comprises an alignment key engageable within a keyway in the deflector.

9. The well system of claim 6, further comprising a hanger settable within the main wellbore to secure a position and an orientation of the tubular housing.

10. The well system of claim 6, further comprising a retrieving tool engageable with a lateral completion and positionable through the window to place the lateral completion into a lateral wellbore, the retrieving tool detachable from the lateral completion and engageable with the core plug receptacle with the running tool removed and retrievable to detach the core plug from the deflector and retrieve the core plug from the well.

11. The well system of claim 10, further comprising a window transition joint positionable through the window of the tubular housing from the main wellbore into the lateral wellbore by engagement with the deflector angled surface, the window transition joint comprising a tubular housing comprising a window through a wall of the tubular housing and a lateral isolation sleeve removably positionable inside the window transition joint to isolate the main wellbore from the lateral wellbore.

12. The well system of claim 6, further comprising a lateral completion and window transition joint assembly positionable through the window of the tubular housing from the main wellbore into a lateral wellbore by engagement with the deflector angled surface.

13. A method for drilling a multilateral well through a formation, the method comprising:

running an assembled deflector assembly into an open-hole portion of a main wellbore with a running tool in a trip, the deflector assembly comprising a tubular housing with a window through a wall of the tubular housing and a core plug;

orienting the deflector assembly within the open-hole portion of the main wellbore with the running tool in the trip, wherein the running tool engages an interior wall of the tubular housing above the window and the core plug below the window;

setting a first hanger in the main wellbore to secure a position and an orientation of the deflector and the window of the tubular housing within the open-hole portion of the main wellbore in the trip; and drilling a lateral wellbore by deflecting a drill bit off of a deflector of the tubular housing and the core plug, and through the window of the tubular housing.

14. The method of claim 13, wherein orienting the deflector assembly within the main wellbore with the running tool comprises:

removably coupling the running tool to the core plug and to the tubular housing uphole of the window;

rotating the running tool to orient the deflector assembly within the main wellbore without transmitting torque through a portion of the wall of the tubular housing comprising the window; and removing the running tool from the tubular housing and the core plug.

15. The method of claim 14 wherein:

removably coupling the running tool to the core plug and to the tubular housing uphole of the window comprises:

engaging the running tool with an inner surface of a receptacle of the core plug, and engaging the running tool with an interior of the wall of the tubular housing uphole of the window; and removing the running tool from the tubular housing and the core plug comprises:

disengaging the running tool from the inner surface of the receptacle, and disengaging the running tool from the inner surface of the wall.

16. The method of claim 13, further comprising removing the core plug with a retrieving tool that is part of a lateral completion running tool, and wherein removing the core plug with the retrieving tool comprises:

running a lateral completion into the lateral wellbore with the lateral completion running tool by deflecting the lateral completion off of the deflector assembly;

releasing the lateral completion from the lateral completion running tool; and removing the core plug with the lateral completion running tool.

17. The method of claim 16, further comprising:

installing a window transition joint through the window of the tubular housing to connect the tubular housing with the lateral completion; and stimulating the formation through the lateral wellbore.

18. The method of claim 17, wherein installing the window transition joint through the window of the tubular housing to connect the tubular housing with the lateral completion further comprises:

running a first work string comprising a shrouded stinger assembly and the window transition joint into the lateral wellbore;

applying a force to shear a shroud of the shrouded stinger and push a seal stinger of the shrouded stinger into the lateral completion; and setting a second hanger in the tubular housing to secure a position and an orientation of the window transition joint.

19. The method of claim 17, further comprising:

removing a lateral isolation sleeve of the window transition joint from the lateral wellbore;

running a second work string comprising a mainbore isolation sleeve into the main wellbore to isolate the lateral wellbore from the main wellbore; and stimulating the formation through the main wellbore.

20. The method of claim 13, further comprising running a lateral completion and window transition joint assembly into the lateral wellbore with a lateral completion running tool by deflecting the lateral completion and window transition joint assembly off of the deflector assembly.

21. The method of claim 13, further comprising retrieving the core plug with a retrieving tool.

* * * * *